US009771197B2

(12) United States Patent
Shin

(10) Patent No.: US 9,771,197 B2
(45) Date of Patent: Sep. 26, 2017

(54) ACCESSORY STORAGE DEVICE

(71) Applicant: Te-Fan Ho, Taipei (TW)

(72) Inventor: Nai-Chi Shin, Hsinchu (TW)

(73) Assignee: Te-Fan HO, Taipei (TW)

( * ) Notice: Subject to any disclaimer, the term of this patent is extended or adjusted under 35 U.S.C. 154(b) by 285 days.

(21) Appl. No.: 14/713,631

(22) Filed: May 15, 2015

(65) Prior Publication Data

US 2015/0336727 A1 Nov. 26, 2015

(30) Foreign Application Priority Data

May 20, 2014 (TW) ..... 103208794 U

(51) Int. Cl.

| | |
|---|---|
| ***B65D 85/48*** | (2006.01) |
| ***B65D 71/00*** | (2006.01) |
| ***B65D 25/20*** | (2006.01) |
| ***B65D 25/54*** | (2006.01) |
| ***B65D 85/38*** | (2006.01) |
| ***B65D 85/62*** | (2006.01) |
| ***A45C 11/18*** | (2006.01) |

(52) U.S. Cl.

CPC ..... *B65D 71/00* (2013.01); *A45C 11/18* (2013.01); *B65D 25/205* (2013.01); *B65D 25/54* (2013.01); *B65D 85/38* (2013.01); *B65D 85/62* (2013.01); *A45C 2011/188* (2013.01); *A45C 2200/10* (2013.01)

(58) Field of Classification Search

CPC ..... B65D 71/00; B65D 85/38; B65D 85/62; A45C 11/18; A45C 11/182; B42F 5/005

USPC ..... 206/39, 39.5, 39.6, 39.8, 307, 311, 312, 206/425, 449, 459.5, 509, 511; 220/23.83; 312/9.4, 9.58

See application file for complete search history.

(56) References Cited

U.S. PATENT DOCUMENTS

| | | | | |
|---|---|---|---|---|
| 2,681,677 | A * | 6/1954 | Poeltl | A45C 1/06 150/138 |
| 3,490,840 | A * | 1/1970 | Eagle | G03B 23/08 353/120 |
| 3,827,551 | A * | 8/1974 | Croft | A45C 3/04 206/214 |
| 4,141,400 | A * | 2/1979 | Mangan | A45C 11/182 150/147 |
| 4,165,890 | A * | 8/1979 | Leff | A61G 12/00 283/46 |
| 5,038,926 | A * | 8/1991 | van der Toorn | B42F 7/00 150/147 |

(Continued)

FOREIGN PATENT DOCUMENTS

TW M331701 5/2008

*Primary Examiner* — Luan K Bui

(74) *Attorney, Agent, or Firm* — Muncy, Geissler, Olds & Lowe, P.C.

(57) ABSTRACT

An accessory storage device comprises a plurality of transparent casings each having a through hole and at least one slot; and a fixing pivot passing through the through hole of each transparent casing to cascade the transparent casings, wherein the slot interconnects with an opening, and wherein an accessory is inserted through the opening into the slot for storage. The transparent casings of the accessory storage device can be spread fanwise to reveal the accessories stored inside the transparent casings or the labels on the transparent casings. Thereby, the user can fast find out the required accessories stored in the accessory storage device.

10 Claims, 6 Drawing Sheets

(56) References Cited

U.S. PATENT DOCUMENTS

| | | | | | |
|---|---|---|---|---|---|
| 5,125,505 | A * | 6/1992 | Kurosaki | A45C 11/182 | 206/38 |
| 5,423,434 | A * | 6/1995 | Chen | G11B 33/0455 | 206/309 |
| 5,848,688 | A * | 12/1998 | Paloheimo | G11B 33/0411 | 206/308.1 |
| 6,732,860 | B1 * | 5/2004 | Stridal | G11B 33/0422 | 206/308.1 |

* cited by examiner

ACCESSORY STORAGE DEVICE

This application claims priority for Taiwan patent application no. 103208794 filed on May 20, 2014, the content of which is incorporated by reference in its entirely.

BACKGROUND OF THE INVENTION

Field of the Invention

The present invention relates to an accessory storage device wherefrom the stored accessory can be drawn out conveniently.

Description of the Related Art

A photographer normally carries about many accessories, such as color filters and memory cards. A color filter is to provide a tinge or mood in photographing a subject, such as a person or an object. A photographer usually arranges a lighting system in front of a flashlight. The lighting system can use different color filters to balance the color temperature variation caused by different light sources. Memory cards are used to record the captured images. Once a memory card is completely occupied, it should be replaced with a new one.

A photographer usually stores color filters or memory cards in an accessory storage box or an accessory storage bag. However, a common accessory storage box is somewhat bulky and inconvenient to carry about. A photographer normally stacks color filters or memory cards in an accessory storage box. While intending to use a color filter or memory card, the photographer has to draw out the color filters or memory cards one by one to identify the colors of the color filters or the numbers of the memory cards. However, such an operation is time-consuming. If the photographer is undertaking a dynamic photograph, he may miss an instantaneous image because he cannot find out the desired color filter or memory card in time. Therefore, it is critical for photographers to fast find out the desired color filter or memory card.

Accordingly, the present invention proposes an accessory storage device to overcome the abovementioned problems.

SUMMARY OF THE INVENTION

The primary objective of the present invention is to provide an accessory storage device, which can be spread fanwise to reveal the accessory stored in each transparent casing or the label on each transparent casing, whereby the user can fast find and draw out the required accessories, wherefore the user can work conveniently and efficiently.

Another objective of the present invention is to provide an accessory storage device, which is compact, easy to carry about, and convenient to store accessories.

To achieve the abovementioned objectives, the present invention proposes an accessory storage device, which comprises a plurality of transparent casings, wherein each transparent casing has a through hole and at least one slot, and wherein an opening interconnects with the slot, and wherein an accessory is inserted through the opening into the slot for storage, and wherein a fixing pivot is inserted through the through holes of the transparent casings to cascade the transparent casings.

Below, embodiments are described in detail in cooperation with the attached drawings to make easily understood the structural characteristics and efficacies of the present invention.

DETAILED DESCRIPTION OF THE INVENTION

Figure 1:
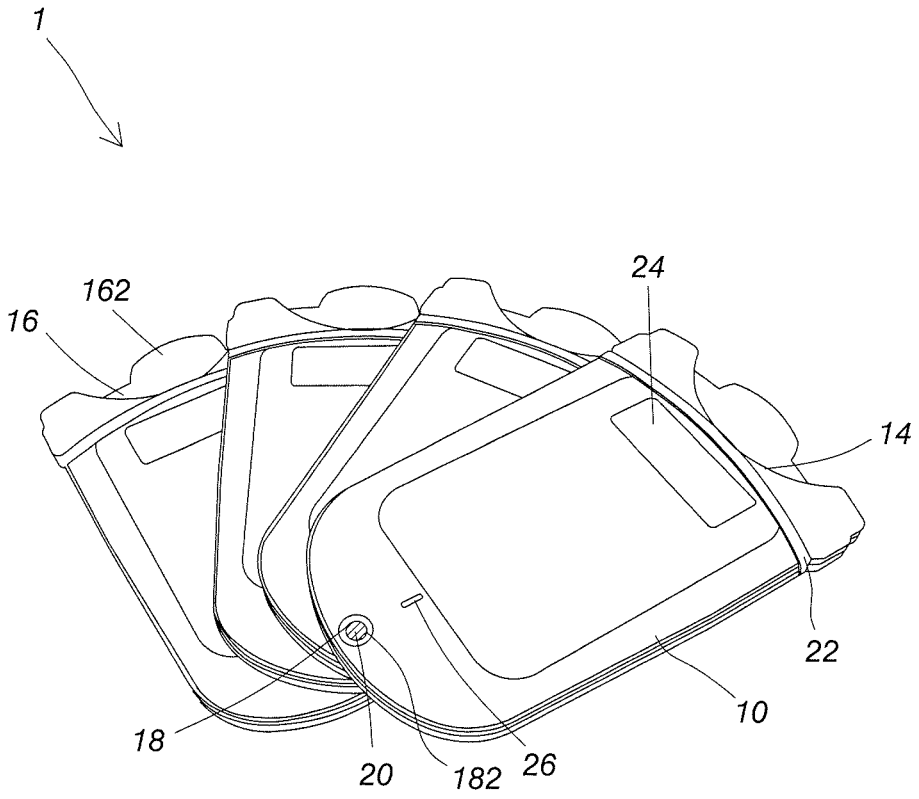
FIG. 1 is a perspective view schematically showing an accessory storage device according to a first embodiment of the present invention.
Figure 2:
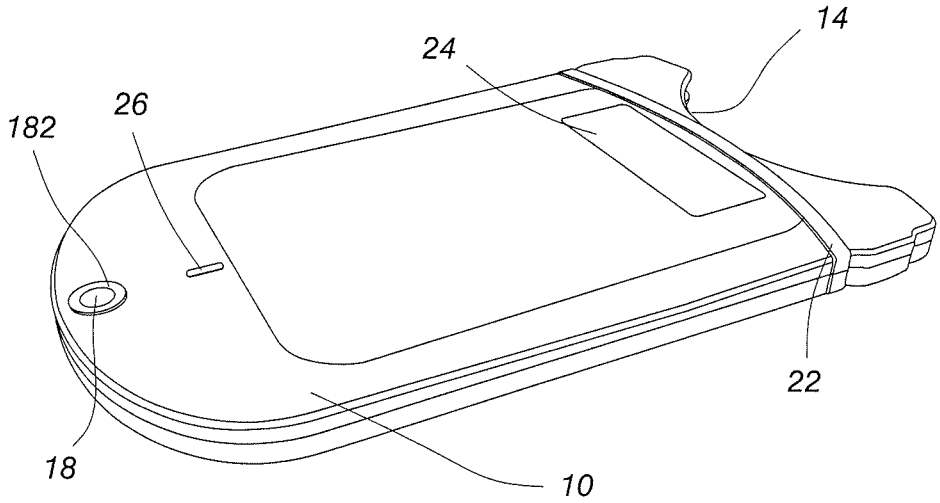
FIG. 2 is a perspective view schematically showing a transparent casing of the accessory storage device according to the first embodiment of the present invention.
Figure 3:
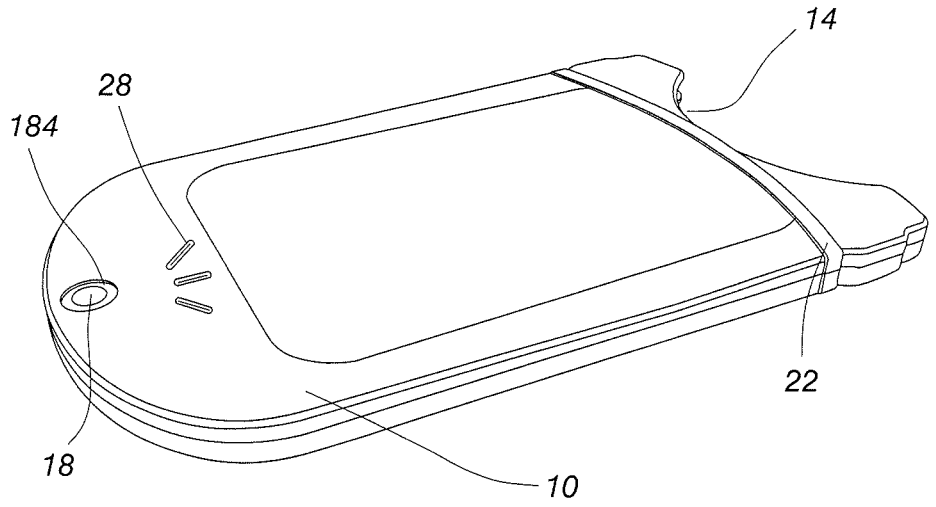
FIG. 3 is a perspective view taken from another viewing angle and schematically showing the transparent casing according to the first embodiment of the present invention.

Refer to FIGS. 1-4 for an accessory storage device according to a first embodiment of the present invention. The accessory storage device 1 of the present invention comprises a plurality of transparent casings 10. Each transparent casing 10 has at least one slot 12 interconnecting with an opening 14. An accessory is inserted through the opening 14 into the slot 12 for storage. In the first embodiment, the stored accessory is exemplified by a color filter 16. Naturally, the stored accessory may also be a flat object, such as a memory card. The appearance of the stored accessory, such as the color of the color filter 16, can be seen through the transparent casing 10. The opening 14 of the transparent casing 10 recedes inward to reveal a draw-out member 162 of the color filter 16, whereby the user can easily draw out the color filter 16. One end of the transparent casing 10 has a through hole 18. In the first embodiment, the through hole 18 is arranged at one end opposite the opening 14. A fixing pivot 20 is inserted through each through hole 20 of each transparent casing 20 to cascade the transparent casings 10. In the first embodiment, the fixing pivot 20 cascades four transparent casings 10. The thickness of the four transparent casings 10 is an optimized thickness convenient for the user to carry it about. A convex ring 182 is arranged around the through hole 18 and on the upper surface of the transparent casing 10. A concave ring 184 is arranged around the through hole 18 and on the lower surface of the transparent casing 10. While two transparent casings 10 are cascaded, the convex ring 182 of one transparent casing 10 is fit into the concave ring 184 of the other transparent casing 10 to enhance the engagement of the transparent casings 10.

Refer to FIGS. 1-4 again. The upper surface and lower surface of each transparent casing 10 respectively have convex abrasion members 22. In the first embodiment, the upper surface and lower surface of each transparent casing 10 respectively have the convex abrasion members 22 arranged at the regions neighboring the opening 14. While the cascaded transparent casings 10 are spread out, abrasion occurs between each two adjacent transparent casings 10. The convex abrasion members 22 function as buffers to make the abrasion not take place on the entire surfaces of the transparent casings 10 but only take place between the convex abrasion members 22, preventing the transparent casings 10 from being damaged by abrasion.

Figure 4:
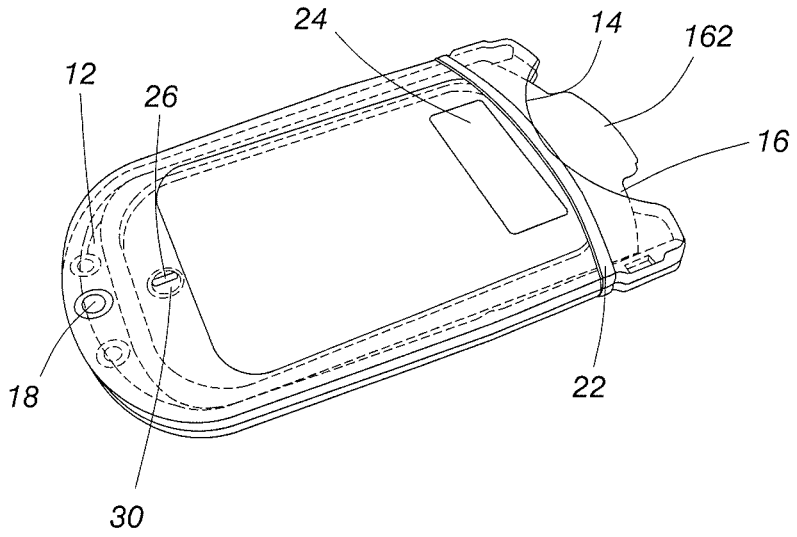
FIG. 4 is a perspective view with the hidden edges and components depicted with dashed lines, which schematically shows the transparent casing according to the first embodiment of the present invention.
Figure 5:
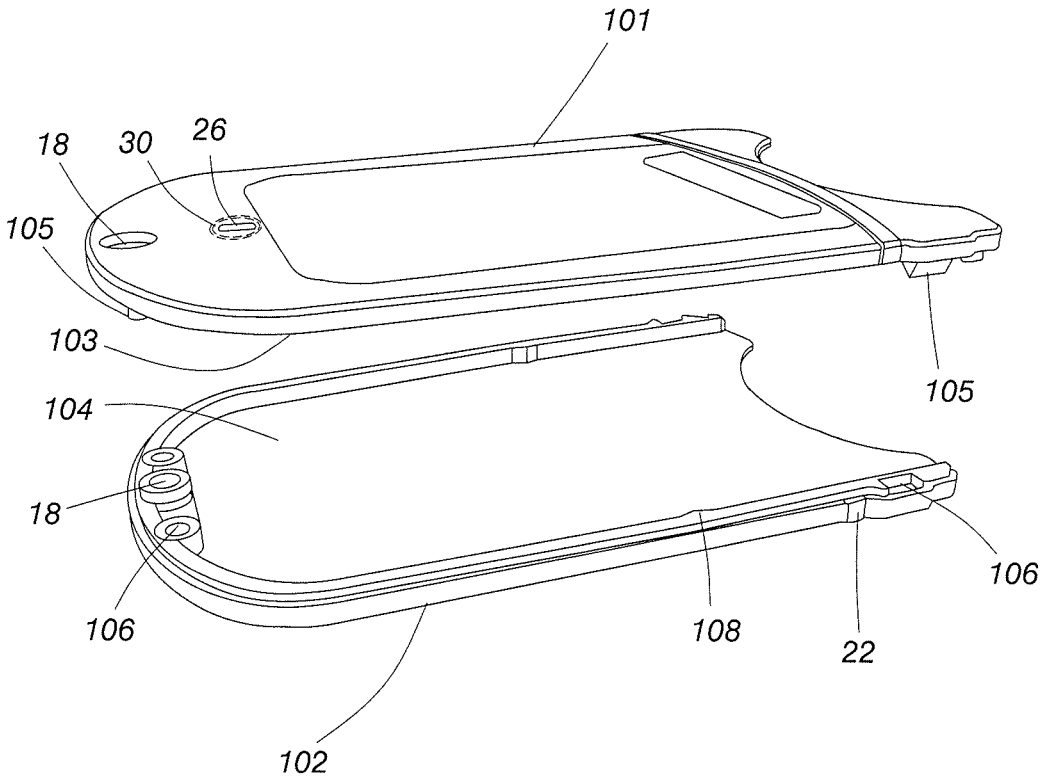
FIG. 5 is an exploded view schematically showing the transparent casing according to the first embodiment of the present invention.

Refer to FIG. 4 and FIG. 5. FIG. 5 is an exploded view schematically showing the accessory storage device according to the first embodiment of the present invention. Each transparent casing 10 includes an upper casing 101 and a lower casing 102. The upper surface of the upper casing 101 has an identification label 24, which may contain text, symbols or figures. The lower surface of the upper casing 101 has at least one first recess 103. The periphery of the first recess 103 has a plurality of fixing convexities 105. The upper surface of the lower casing 102 has at least one second recess 104. The periphery of the second recess 104 has a plurality of fixing concavities 106 corresponding to the fixing convexities 105. The fixing convexities 105 are press-fitted into the fixing concavities 106 to assemble the upper casing 101 and the lower casing 102 into the transparent casing 10 and make the first recess 103 and the second recess 104 cooperate to form the slot 12. The fixing concavity 106 is a fixing mortise or a fixing notch. The fixing convexity 105 is a fixing tenon or a fixing protrusion. In the first embodiment, the fixing convexities 105 arranged along the periphery of the first recess 103 are fixing tenons; the fixing convexities 105 arranged at two sides of the through hole 18 are fixing protrusions; the fixing concavities along the periphery of the second recess 106 are fixing mortises; the concavities arranged at two sides of the through hole are fixing notches. Two sides of the second recess 104 of the lower casing 102 respectively have securing protrusions 108. While the color filter 16 is inserted into the slot 12, the securing protrusions 108 will secure the color filter 16 lest the color filter 16 slip out from the slot 12.

Refer to FIGS. 1-3 and FIG. 5. The upper surface of the upper casing 101 has at least one positioning protuberance 26 in front of the through hole 18; the lower surface of the lower casing 102 has at least one positioning notch 28 in front of the through hole 18. The two neighboring cascaded transparent casings 10 are positioned firmly via press-fitting the positioning protuberance 26 into the positioning notch 28. In the first embodiment, there are three positioning notches 28 arranged fanwise on the surface of the transparent casing 10. Thereby, the transparent casings 10 are spread fanwise and positioned securely by the positioning protuberance 26 and the positioning notches 28. In the first embodiment, a recession 30 is formed on the lower surface of the upper casing 101 and corresponding to the positioning protuberance 30 so as to make the region around the positioning protuberance 26 thinner than the other region of the upper casing 101. Thereby, the positioning protuberance 26 can be moved up and down more elastically, and the positioning protuberance 26 can be more easily press-fitted into the positioning notch 28 of another transparent casing 10. After having been spread out fanwise, the transparent casings 10 will not move relatively but is positioned securely with the label 24 and the color of the color filter 16 exactly revealed, as shown in FIG. 1. Thus, the user can fast draw out the required color filter 16.

Figure 6:
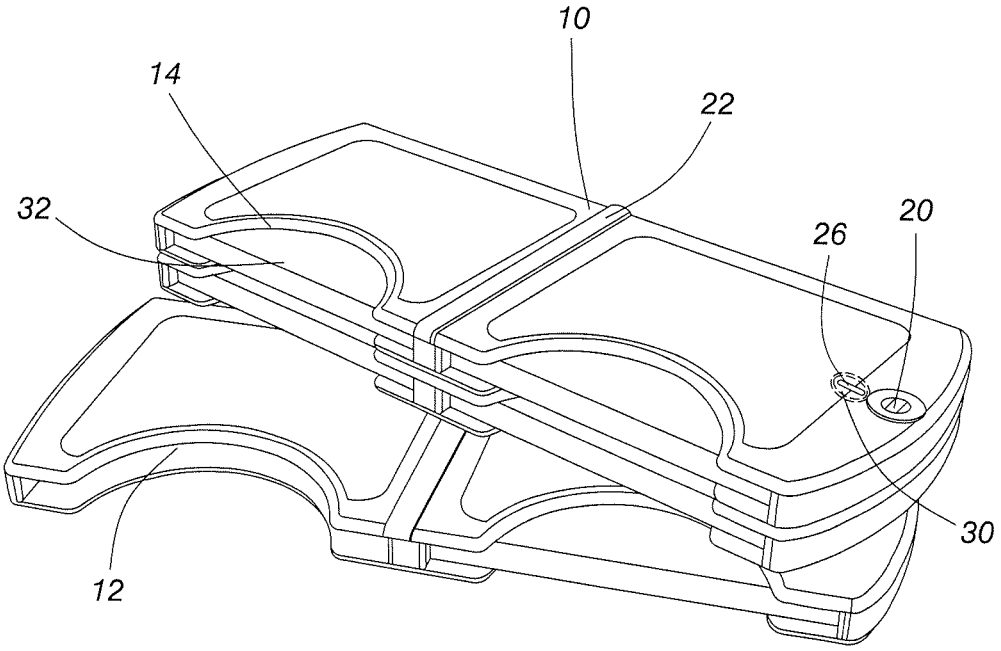
FIG. 6 is a perspective view schematically showing an accessory storage device according to a second embodiment of the present invention.

Refer to FIG. 6 for a second embodiment. In the second embodiment, the transparent casing 10 has a plurality of slots 12. In such a case, the accessories stored inside the slot 12 may be memory cards 32. The slots 12 are parallel arranged in the transparent casing 10. Each slot 12 interconnects with an opening 14. The memory card 32 is inserted through the opening 14 into the slot 12 for storage. A convex abrasion member 22 is arranged between two slots 12 to function as a buffer and prevent from that abrasion takes place on the entire surfaces of the transparent casings 10 lest the transparent casings 10 be damaged by abrasion. The second embodiment is different from the first embodiment only in that the transparent casing 10 has a plurality of slots 12. The internal structure of the slot 12 and the other structure of the second embodiment are similar to those of the first embodiment and will not repeat herein.

In conclusion, the present invention proposes an accessory storage device whose transparent casings can be spread fanwise to reveal the accessory stored in each transparent casing. The user can operate the accessory storage device easily, use the accessory storage device to store color filters compactly and carry them about conveniently.

The embodiments described above are only to exemplify the present invention but not to limit the scope of the present invention. Any equivalent modification or variation according to the characteristic or spirit of the present invention is to be also included within the scope of the present invention.

What is claimed is:

1. An accessory storage device comprising:

a plurality of transparent casings each having a through hole and at least one slot, wherein said at least one slot interconnects with at least one opening, and wherein an accessory is inserted through said at least one opening into said at least one slot for storage; and a fixing pivot passing through said through hole of each of said plurality of transparent casings to cascade said plurality of transparent casings, wherein each of said plurality of transparent casing further comprises:

an upper casing whose lower surface has at least one first recess, wherein a periphery of said first recess has a plurality of fixing convexities; and a lower casing whose upper surface has at least one second recess, wherein a periphery of said second recess has a plurality of fixing concavities corresponding to said fixing convexities, and wherein said fixing convexities are press-fitted into said fixing concavities to assemble said upper casing and said lower casing and make said first recess and said second recess cooperate to form said at least one slot, wherein an upper surface of said upper casing has at least one positioning protuberance in front of said through hole, and wherein a recession is formed on said lower surface of said upper casing and corresponding to said positioning protuberance, and wherein a lower surface of said lower casing has at least one positioning notch in front of said through hole, and wherein while said plurality of transparent casings are cascaded, said positioning protuberance of one of said plurality of transparent casings is press-fitted into said positioning notch of another of said plurality of transparent casings to position said plurality of transparent casings securely.

2. The accessory storage device according to claim 1, wherein at least one securing protrusion is arranged at two sides of said second recess of said lower casing to secure said accessory stored in said at least one slot.

3. The accessory storage device according to claim 1, wherein said through hole is arranged at one end of each of said plurality of transparent casings.

4. The accessory storage device according to claim 3, wherein said fixing concavity is a fixing mortise or a fixing notch, and wherein said fixing convexity is a fixing tenon or a fixing protrusion.

5. The accessory storage device according to claim 1, wherein an upper surface of said upper casing has at least one identification label.

6. The accessory storage device according to claim 1, wherein said at least one opening of each of said plurality of transparent casings recedes inward to reveal said stored accessory.

7. The accessory storage device according to claim 1, wherein an upper surface and a lower surface of each of said plurality of transparent casings respectively have convex abrasion members.

8. The accessory storage device according to claim 1, wherein a convex ring is arranged around said through hole and on an upper surface of said transparent casing, and wherein a concave ring is arranged around said through hole and on a lower surface of said transparent casing, and wherein while two said transparent casings are cascaded, said convex ring is fit into said concave ring.

9. The accessory storage device according to claim 1, wherein said at least one slot is a flat slot.

10. The accessory storage device according to claim 1, wherein each of plurality of said transparent casings is a flat transparent casing.

* * * * *